US011274824B2

(12) United States Patent
Karjunen

(10) Patent No.: US 11,274,824 B2
(45) Date of Patent: Mar. 15, 2022

(54) FURNACE FLOOR PROTECTION IN RECOVERY BOILERS

(71) Applicant: Varo Teollisuuspalvelut Oy, Helsinki (FI)

(72) Inventor: Timo Karjunen, Helsinki (FI)

(73) Assignee: Varo Teollisuuspalvelut Oy, Helsinki (FI)

( * ) Notice: Subject to any disclaimer, the term of this patent is extended or adjusted under 35 U.S.C. 154(b) by 97 days.

(21) Appl. No.: 16/747,595

(22) Filed: Jan. 21, 2020

(65) Prior Publication Data

US 2021/0010673 A1 Jan. 14, 2021

(30) Foreign Application Priority Data

Dec. 5, 2019 (FI) ..... 20196059

(51) Int. Cl.
*F23G 7/04* (2006.01)
*F23M 5/00* (2006.01)

(52) U.S. Cl.
CPC ..... *F23G 7/04* (2013.01); *F23M 5/00* (2013.01); *F23G 2209/101* (2013.01); *F23G 2900/50005* (2013.01); *F23M 2900/05001* (2013.01)

(58) Field of Classification Search
CPC ..... F23G 7/04; F23G 2209/101; F23M 5/00; F23M 2900/05001; F23M 2900/05004; D21C 11/12; F27D 1/0043; F27D 1/00; B05C 9/00
See application file for complete search history.

(56) References Cited

U.S. PATENT DOCUMENTS

| | | | | |
|---|---|---|---|---|
| 1,689,534 | A | 10/1928 | Richter | |
| 1,961,351 | A | 6/1934 | Anton | |
| 2,789,881 | A * | 4/1957 | Frankw | F27B 1/10 423/207 |
| 5,478,440 | A * | 12/1995 | Paju | D21C 11/12 162/30.1 |
| 5,603,803 | A * | 2/1997 | Raak | F23G 5/46 162/31 |
| 2009/0266277 | A1* | 10/2009 | Karjunen | F27D 3/14 110/259 |
| 2011/0232688 | A1* | 9/2011 | Karjunen | D21C 11/12 134/21 |
| 2015/0233579 | A1* | 8/2015 | Imig | F23C 5/06 431/6 |

(Continued)

FOREIGN PATENT DOCUMENTS

| | | | |
|---|---|---|---|
| CN | 101746781 | A | 6/2010 |
| WO | 9317179 | A1 | 9/1993 |
| WO | 9409206 | A1 | 4/1994 |

OTHER PUBLICATIONS

Hough, G, Chemical Recover in the Alkaline Pulping, Processes, TAPPI, 1985, 6 pages.

(Continued)

*Primary Examiner* — David J Laux
(74) *Attorney, Agent, or Firm* — Ziegler IP Law Group, LLC

(57) ABSTRACT

A method and apparatus for protecting a furnace floor of a black liquor recovery boiler, where a mixture is formed by mixing material with a fluid, and the furnace floor is covered by said mixture by flowing the formed mixture onto the floor from the outside of the furnace.

13 Claims, 7 Drawing Sheets

(56) References Cited

U.S. PATENT DOCUMENTS

| | | | | |
|---|---|---|---|---|
| 2018/0193888 | A1* | 7/2018 | Karjunen | D21C 11/12 |
| 2018/0363900 | A1* | 12/2018 | Mansikkasalo | D21C 11/066 |
| 2019/0078773 | A1* | 3/2019 | Roppanen | F22B 21/002 |

OTHER PUBLICATIONS

The International Search Report and Written Opinion of the International Searching Authority, Application No. PCT/FI2019/050048, dated Oct. 8, 2019, 6 pages.
Hogan, E.F., "Investigation of Chemical Recovery Unit Floor Tube Overheat Failures", In: Tappi Journal, Feb. 1999, vol. 82, No. 2, 6 pages.
"Working Towards a Safer Recovery Boiler Operation", In: Valmet Technical Paper Series, 2017, July, Published Jul. 10, 2017, 5 pages.
"Recovery boiler floor protection", Valmet Technical Paper Series, Feb. 2019, Published Feb. 4, 2019, 7 pages.
Vakkilainen, Esa K. "Kraft recovery boilers—Principles and practice" Copyright 2005, Publisher: Suomen Soodakattilayhdistys r.y., Printer: Valopaino Oy, Helsinki Finland, Year: 2005, ISBN: 952-91-8603-7, 246 pages.
Daniel Lindberg, "Thermochemistry and melting properties of alkali salt mixtures in black liquor conversion processes" Academic Dissertation, Laboratory of Inorganic Chemistry, Feb. 2007, Report 07-03, Åbo Akademi University, Faculty of Technology, Process Chemistry Centre, Laboratory of Inorganic Chemistry, 142 pages.
Swedish Patent and Registration Office, Swedish Search Report, U.S. Appl. No. 20/500,153, dated Sep. 17, 2020, 10 pages.
Wensley. A. "Inspection Experience with Recovery Boiler Floors", TAPPI Fall Technical Conference, Atlanta, Oct. 2004, 32 pages.
Finnish Patent and Registration Office, Search Report, U.S. Appl. No. 20/196,059, dated Jun. 24, 2020, 1 Page.
United States Patent and Trademark Office, Non-Final Office Action, U.S. Appl. No. 16/747,585, dated Sep. 22, 2021, 21 pages.
Pohjanne et al, "Advanced composite tube materials for lower furnace in black liquor recovery boilers", In: Baltica V Condition and Life Management for Power Plants, Porvoo, Finland, Jun. 6-8, 2001, 13 pages.
Swedish Patent and Registration Office, Application No. 2050016-1, dated Nov. 3, 2021, 6 pages.

* cited by examiner

FURNACE FLOOR PROTECTION IN RECOVERY BOILERS

TECHNICAL FIELD

The aspects of the disclosed embodiments generally relate to recovery boilers. The aspects of the disclosed embodiments particularly, though not exclusively, to protecting recovery boiler floor tubes.

BACKGROUND ART

This section illustrates useful background information without admission of any technique described herein representative of the state of the art.

Recovery boilers are fueled with waste liquor (black liquor) generated in connection with pulp manufacturing. Black liquor is a highly corrosive substance which is combusted in a furnace area of the boiler.

The floor of the recovery boiler furnace is made of tubes that are filled with water. If the floor tubes are directly exposed to black liquor, this may lead in unfavorable conditions that promote local corrosion or cracking of the floor tubes. During recovery boiler start up, after recovery boiler outage, the floor tubes may additionally be exposed to an excessive heat load due to start-up burner flame impingement if not protected.

In order to protect the floor tubes, a protective layer of a protecting chemical, such as sodium sulfate, may be spread onto the furnace floor during recovery boiler outage after the floor tubes have been inspected. The spreading of the chemical, however, is laborious requiring manual labor in terms of carrying bags into the furnace and spreading the bags/powder to cover the floor.

SUMMARY

According to a first aspect of the disclosed embodiments, there is provided a method for protecting a furnace floor of a black liquor recovery boiler, comprising:

mixing protective material with a fluid to form a mixture comprising said protective material; and covering the furnace floor by said mixture by allowing the mixture to stay on the furnace floor or by flowing the mixture onto the furnace floor.

In certain embodiments, the mixing and covering are performed during recovery boiler outage.

In certain embodiments, the protective material contains salt. In certain embodiments, the material is or comprises a recovery boiler process chemical, such as sodium sulfate, sodium carbonate or another inorganic sodium salt. In certain embodiments, the material is sodium containing material. In certain embodiments, the sodium containing material is a sodium salt, such as sodium sulfate or sodium carbonate. In certain embodiments, the mixture is free of organic material. In certain embodiments, the mixing consists of blending the protective material with water.

In certain embodiments, the said covering is to form a protective layer. In certain embodiments, the protective layer is to protect the floor against direct exposure of black liquor. In certain embodiments, the protective layer is to protect the floor against start up burner flame impingement. In certain embodiments, an empty or emptied furnace floor is covered, the term empty or emptied referring to a furnace floor that is not covered by hot smelt. In certain embodiments, this means a washed or otherwise cleaned furnace floor.

In certain embodiments, the said mixing is performed by mixing the material forming the protective layer with fluid or water. In certain embodiments, the mixing is performed without a chemical reaction. Accordingly, the material forming the protective layer merely dissolves in the fluid or water.

In certain embodiments, the method comprises covering the furnace floor by said mixture by flowing the formed mixture onto the floor from the outside of the furnace.

In certain embodiments, the method comprises causing the mixture to flow onto the furnace floor from the outside of the furnace via an opening in a wall of the black liquor boiler.

In certain embodiments, the method comprises pumping the mixture onto the furnace floor from the outside of the furnace. In other embodiments, the protective material is mixed with the fluid only on the furnace floor.

In certain embodiments, the mixing is performed in connection with pumping the mixture onto the furnace floor. In certain embodiments, said mixing is performed during said pumping or prior to said pumping. In certain embodiments, the furnace floor is used as a mixing vessel.

In certain embodiments, the method comprises feeding the protective material (salt containing material) onto the furnace floor. In certain embodiments, the method comprises feeding the protective material onto the furnace floor by pumping. In certain embodiments, the protective material is blown onto the furnace floor. In certain embodiments, the protective material is mixed with water on the furnace floor. The resulting mixture is allowed to stay on the furnace floor. Accordingly, in certain embodiments, the furnace floor is used as a mixing vessel.

In certain embodiments, the method comprises feeding water onto the furnace floor.

In certain embodiments, the method comprises mixing the protective material with water on the furnace floor by one mixing device or a plurality of mixing devices. In certain embodiments, the mixing device(s) is/are operated through at least one opening in the furnace wall. In certain embodiments, the mixing device(s) is/are operated by a pressure medium, for example, pressurized air. In certain embodiments, the mixing device(s) is/are set (or installed) on the furnace floor.

In certain embodiments, the method comprises:

feeding the protective material onto the furnace floor; and mixing the protective material on the furnace floor with water by a mixing device or by a plurality of mixing devices.

In certain embodiments, the protective material is fed onto the furnace floor as a continuous kind of process (such as pumping or blowing). In certain embodiments, such a process is a non-manual process (non-manual feed).

In certain embodiments, the method comprises providing the mixture as an aqueous solution.

In certain embodiments the said mixing material with a fluid to form a mixture (or providing the mixture as an aqueous solution) is an in-situ or on-site process in contrast to any off-site process in which the mixture or aqueous solution would be formed elsewhere, e.g., another factory location, and transferred to the recovery boiler facility (or building) therefrom.

In certain embodiments, the method comprises:

performing the act of covering the furnace floor with said mixture simultaneously with a removal of a furnace safety roof during outage.

In certain embodiments, the method comprises settling the flown mixture on the floor by gravity alone.

In certain embodiments, the method comprises forming a salt lake onto the floor extending over the floor from side to side during recovery boiler outage. In certain embodiments, the salt lake contains the protective material.

In certain embodiments, the method comprises allowing the salt lake to solidify forming a protective layer to protect floor tubes of the furnace from direct exposure of black liquor and flame impingement.

In certain embodiments, the material comprises at least two different salts.

In certain embodiments, the material comprises at least two different salts selected from a group consisting of: sodium carbonate, sodium sulfate, sodium sulfide, sodium chloride, potassium carbonate, and potassium sulfate.

In certain embodiments, the method comprises using a mixture whose melting point, after solidification, is lower than 850° C.

According to a second aspect of the disclosed embodiments, there is provided an apparatus for protecting a furnace floor of a black liquor recovery boiler, comprising means for performing the method of the first aspect or any of its embodiments.

Accordingly, in accordance with the second aspect, there is provided an apparatus for protecting a furnace floor of a black liquor recovery boiler, comprising:

mixing means for mixing material with a fluid to form a mixture; and covering means to cover the furnace floor by said mixture by allowing said mixture to stay on the furnace floor or by flowing the mixture onto the furnace floor.

In certain embodiments, the mixing means comprises a container. In certain embodiments, the mixing means comprises a mixer. In certain embodiments, the covering means comprises a pipe and an optional pump to feed the mixture onto the furnace floor.

Different non-binding example aspects and embodiments of the present disclosure have been presented in the foregoing. The embodiments in the foregoing are used merely to explain selected aspects or steps that may be utilized in implementations of the present disclosure. Some embodiments may be presented only with reference to certain aspects of the disclosed embodiments. It should be appreciated that corresponding embodiments may apply to other aspects as well, and any appropriate combinations may be formed.

BRIEF DESCRIPTION OF THE DRAWINGS

Some example embodiments of the present disclosure will be described with reference to the accompanying drawings, in which.

DETAILED DESCRIPTION

In the following description, like reference signs denote like elements or steps.

Figure 1:
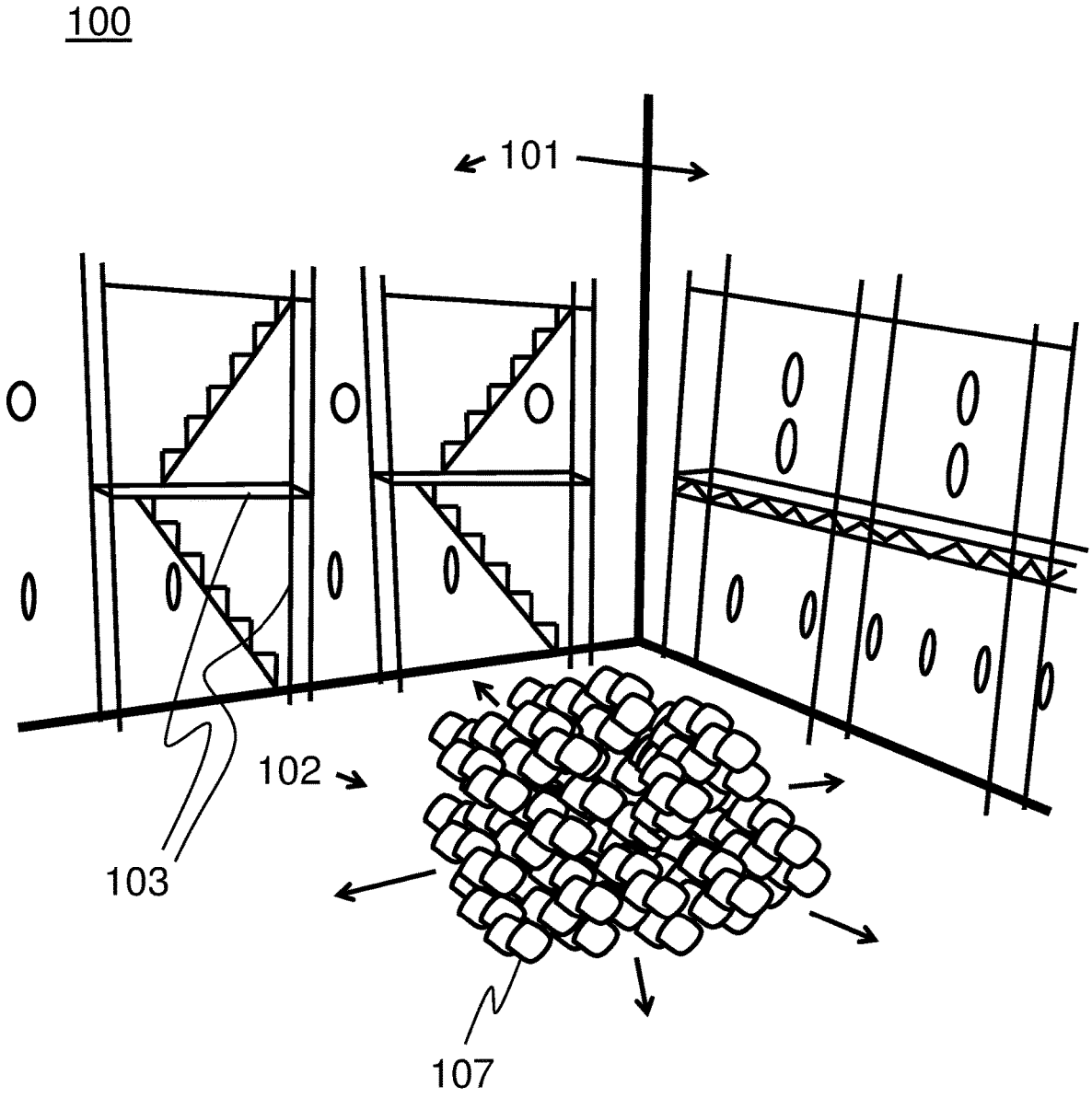
FIG. 1 depicts a conventional method for protecting a recovery boiler floor.

FIG. 1 depicts a conventional method for protecting a furnace floor of a black liquor recovery boiler. The furnace 100 is bounded by furnace walls 101 and the furnace floor 102 made of water tubes. Since FIG. 1 depicts the situation during a late phase of a recovery boiler maintenance break, i.e., recovery boiler outage, the furnace floor 102 has already been cleaned and inspected for cracks, and there are typically scaffoldings 103 within the furnace 100 at this moment. Also a safety roof has been installed into an upper part of the furnace 100 to ensure that any manual labor on the furnace floor 102 can be performed safely. A pile of sodium sulfate bags 107 has been brought onto the floor 102 for spreading. Once spread onto floor tubes, the sodium sulfate serves to protect the floor 102 from direct exposure of forthcoming black liquor and start-up burner flame impingement. The floor protecting method continues as follows: The spreading of the sodium sulfate is performed by manual labor, and the safety roof is removed thereafter.

It has been observed that especially in large boilers the conventional method of providing the floor with the protecting material is laborious and time-consuming. The outage time could be shortened if the protecting material could be provided onto the furnace floor more quickly.

Figure 2:
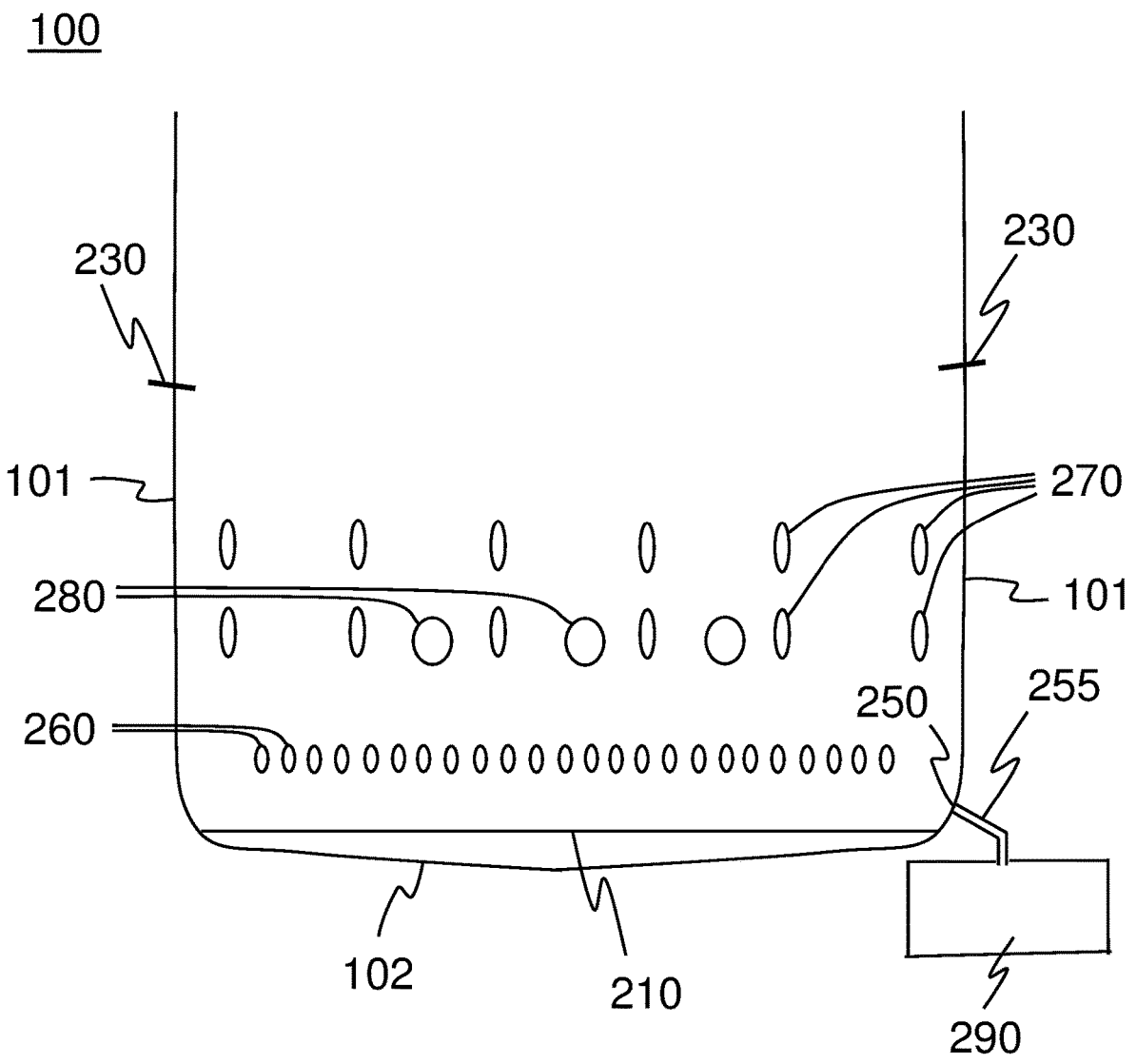
FIG. 2 shows a schematic drawing of floor protection in accordance with an embodiment of the present disclosure.

FIG. 2 shows an obtained result of floor protection in accordance with an embodiment of the present disclosure. The reference numeral 210 depicts a solidified lake of protective material on the furnace floor 102 forming a protective layer that covers the floor tubes of which the floor 102 is made.

The protective layer of protective material is provided by a method comprising mixing appropriate material with a fluid, for example water, to form a mixture, and covering the furnace floor 102 by said mixture by flowing the formed mixture onto the floor 102 from the outside of the furnace 100.

In certain embodiments, the method comprises causing the mixture to flow onto the furnace floor 102 from the outside of the furnace 100 via an opening in the wall of the black liquor recovery boiler, or furnace wall 101. FIG. 2 shows several openings in the furnace wall 101, such as, smelt spout opening(s) 250, primary air openings 260, secondary air openings 270, and start-up burner openings 280.

FIG. 2 also shows black liquor nozzles 230 used to spray black liquor into the furnace, via respective black liquor nozzle openings, during normal operation of the boiler, as well as the smelt spout(s) 255 pouring an overflow of smelt from the floor 102 into a dissolving tank 290 during normal operation.

In certain embodiments, the mixture is caused to flow via at least one smelt spout opening 250. In certain embodiments, the mixture is caused flow via at least one primary air opening 260. In certain embodiments, the mixture is caused flow via at least one secondary air opening 270. In addition or instead, a man door opening residing in the wall 101 and/or at least one start-up burner opening 280 and/or at least one black liquor nozzle opening may be used.

In certain embodiments, the formed lake is allowed to solidify forming a protective layer to protect floor tubes of the furnace 100 from direct exposure of black liquor and flame impingement.

Figure 3:
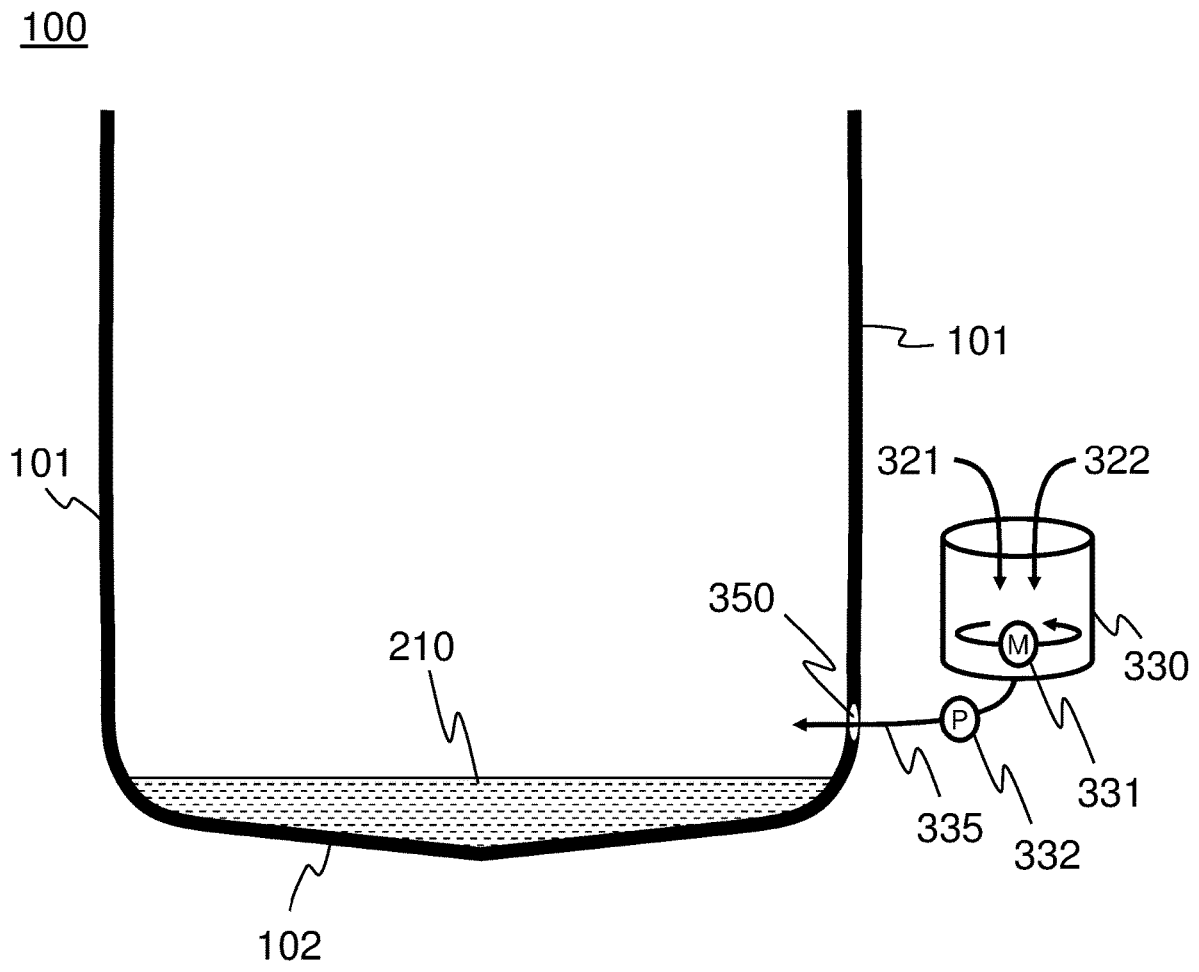
FIG. 3 shows a schematic drawing of an arrangement for providing recovery boiler furnace floor tube protection in accordance with an embodiment.

In certain embodiments, the method comprises pumping the mixture onto the furnace floor 102 from the outside of the furnace 100. FIG. 3 shows such an arrangement or apparatus in which material 321 and fluid (or water) 322 is mixed in a container 330 or similar on the outside of the furnace 100. The mixing may involve agitation caused by a mixer 331. In an embodiment, the mixer 331 is operated by at least one motor. The formed mixture is pumped along an in-feed line 335 by a pump 332 via an opening 350 (which may be any suitable opening as discussed in the preceding) in the furnace wall 101 onto the floor 102. In an alternative embodiment, the mixture flows along the in-feed line 335 merely based on gravity or based on fluid (or water) pressure.

In certain embodiments, the mixture flown onto the floor settles on the floor by gravity alone forming a lake 210 extending over the whole area of the floor 102. The lake 210 is allowed to solidify forming a protective layer. In certain embodiments, the fluid/water in the lake evaporates, which evaporation may be enhanced by firing oil or gas using start-up burners, and a solid layer of protective material is formed.

Figure 4:
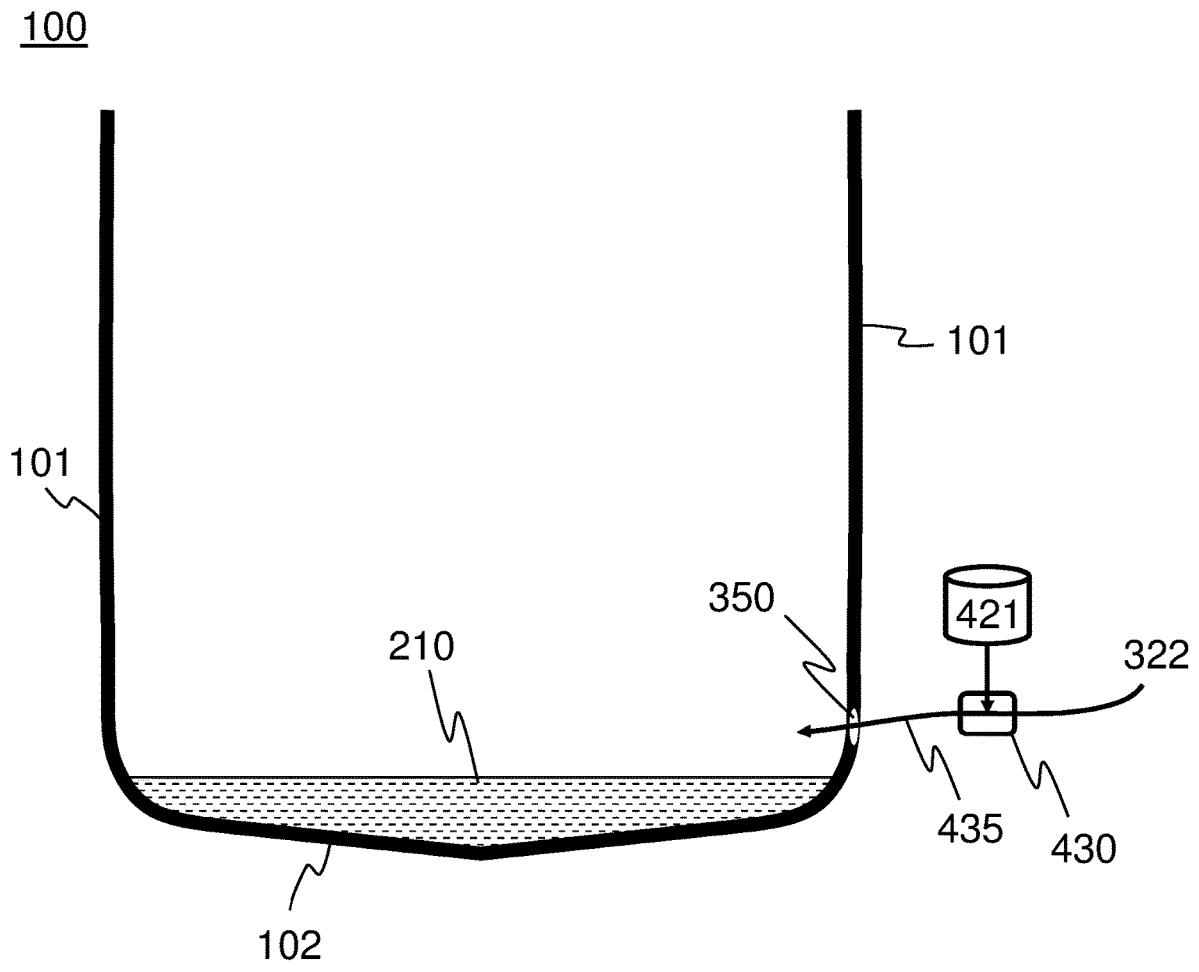
FIG. 4 shows a schematic drawing of an arrangement for providing recovery boiler furnace floor tube protection in accordance with another embodiment.

In certain embodiments said mixing is performed prior to said pumping such as presented in connection with FIG. 3. In certain other embodiments, mixing is performed during said pumping (or simultaneously with flowing the mixture onto the furnace floor 102). This is shown in FIG. 4, in which material from a container 421 is mixed with incoming fluid (or water) 322 in a dosing device 430, and the mixture is flown along an in-feed line 435 via the opening 350 onto the floor 102. Alternatively, the mixing may occur on the furnace side of the opening 350. For example, the dosing device 430 may reside on the furnace side of the opening 350. The mixture flows along the in-feed line 435 driven by a pump, or merely based on gravity, and/or based on fluid (or water) pressure.

In certain embodiments, the method comprises performing the act of covering the furnace floor with said mixture simultaneously with a removal of the furnace safety roof 105 during outage. Since the presented method does not require workers inside of the furnace 100, the safety roof 105 can be removed simultaneously with flowing the mixture onto the floor 102 and spreading it by gravitation.

Figure 6:
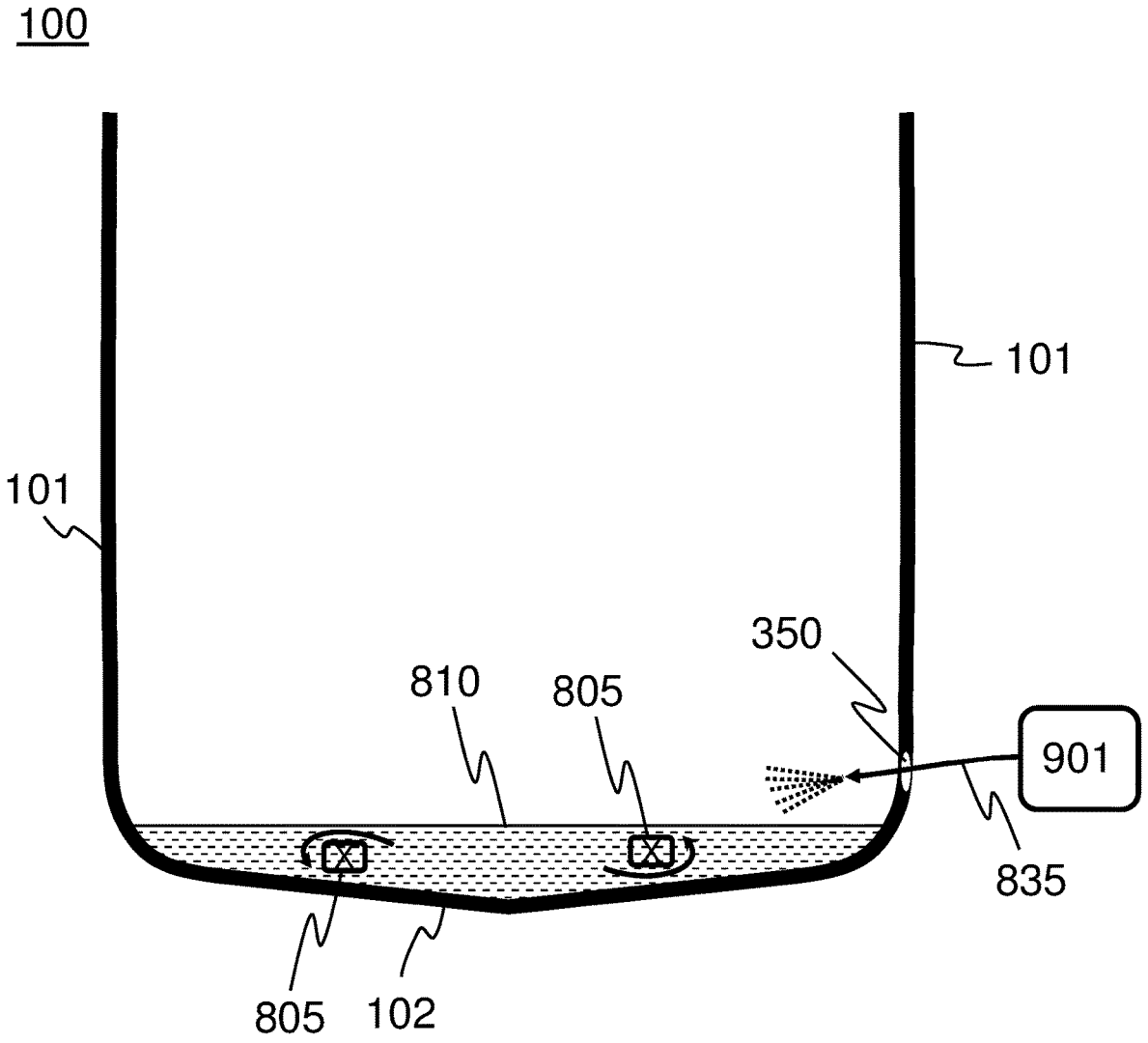
FIG. 6 shows a schematic drawing of an arrangement for providing recovery boiler furnace floor tube protection in accordance with yet another embodiment.

In certain embodiments, as shown in FIG. 6, the method comprises feeding the protective material (salt containing material, or salt(s)) onto the furnace floor 102. In certain embodiments, the protective material is pumped or blown onto the furnace floor 102 from a container or respective containers 901 along an in-feed line or respective in-feed lines 835. The protective material is mixed with water on the furnace floor. The water may be present on the furnace floor 102 when the protective material feed commences or the water can be fed onto the furnace floor 102 later and/or in connection with the protective material feed. In certain embodiments, the mass of water with which the protective material is mixed is twice the total mass of the protective material, as an example.

Accordingly, in certain embodiments, the method comprises feeding water onto the furnace floor 102, for example by pumping. A salt lake 810 is formed onto the floor 102. The protective material in the salt lake 810 is mixed with water of the salt lake by one mixing device 805 or a plurality of mixing devices 805. The mixture of protective material and water (or the formed aqueous solution) is allowed to solidify (the mixture is allowed to precipitate or crystallize) forming a protective layer to protect floor tubes of the furnace 100 from direct exposure of black liquor and flame impingement.

Any suitable opening in the furnace wall 101 (generally depicted as opening 350 as discussed in the preceding) may be used to feed in the protective material and/or water.

Figure 7:
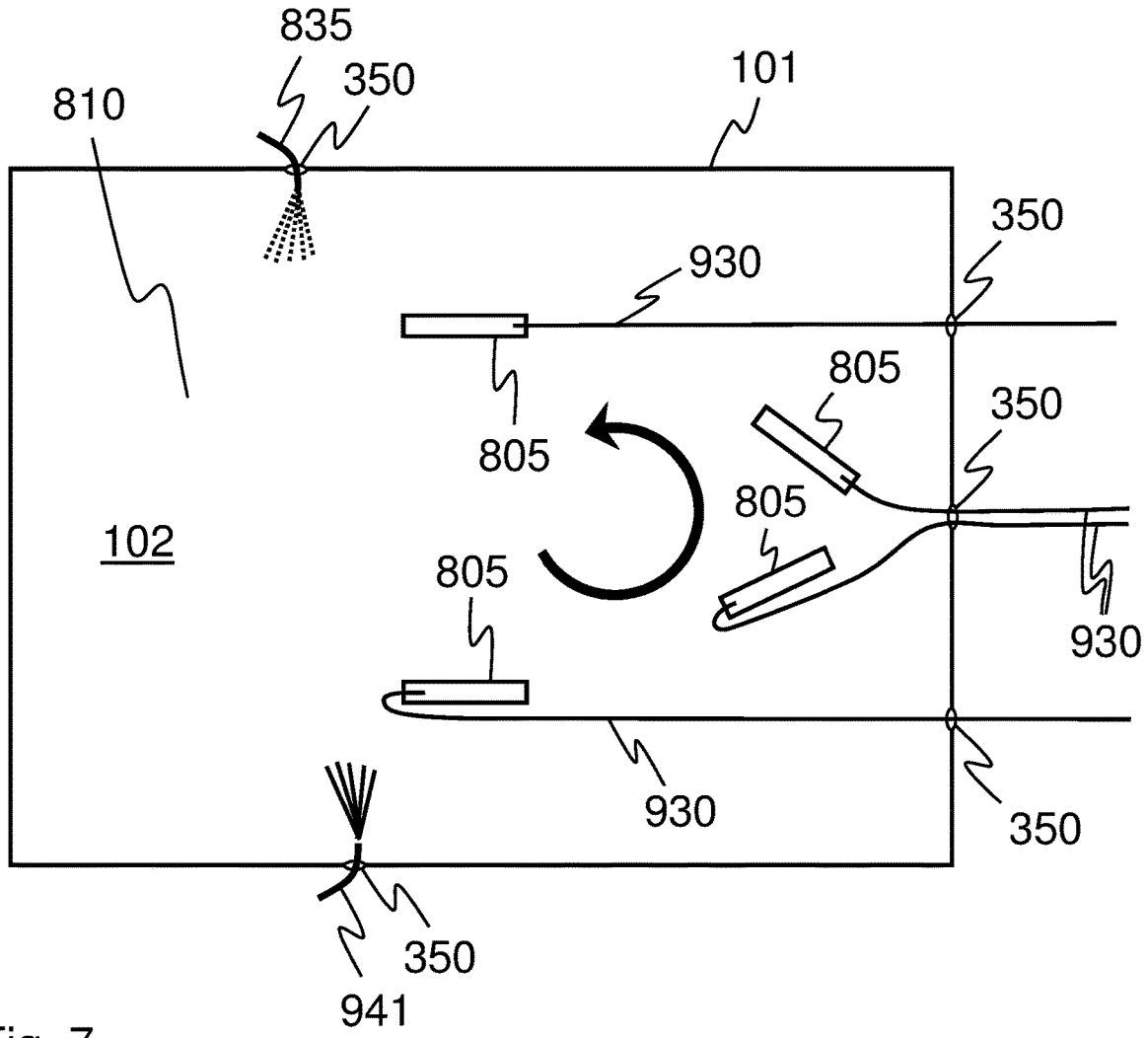
FIG. 7 shows a schematic top view of an arrangement of the type shown in FIG. 6.

FIG. 7 shows a schematic top view of an arrangement of the type shown in FIG. 6. Preferably fresh water is fed via an opening 350 along a water in-feed line or hose 941 onto the furnace floor 102 (unless there is already adequately water on the floor). The protective material is fed onto the furnace floor 102 via the same or different opening 350 onto the floor 102 along the in-feed line(s) 835. The protective material is mixed with the water on the furnace floor 102. A salt lake 810 is thereby formed.

In certain embodiments, the mixing is implemented by one or more mixing devices 805 set or installed on the furnace floor 102. In certain embodiments, the mixing device(s) 805 form a desired circulation of water and salt(s) (protective material). The mixing by mixing device(s) 805 aids in forming the mixture of water and protective material as an aqueous solution in which the protective material is mainly or wholly in a dissolved state. Thereafter the mixing device(s) 805 are removed from the furnace 100. The mixture of protective material and water (or the formed aqueous solution) is allowed to solidify (the mixture is allowed to precipitate or crystallize while the water evaporates) forming a protective layer to protect floor tubes of the furnace 100 from direct exposure of black liquor and flame impingement.

In certain embodiments, a mixing arrangement comprising one or a plurality of mixing devices is used. The mixing device(s) are operated through at least one opening 350 in the furnace wall 101. The opening 350 may preferably be a smelt spout opening.

Figure 8:
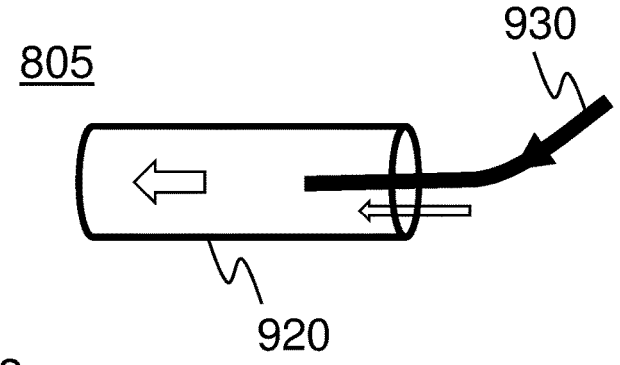
FIG. 8 shows a mixing device in accordance with an embodiment.

In certain embodiments, the mixing device(s) 805 are operated by a pressure medium, for example, pressurized air. In certain embodiments, a pressure medium pipe 930 enters the furnace 100 via said opening 350. The mixing devices in FIG. 7 are kind of ejectors (however missing a diffuser typical to ejectors). A respective pressure medium pipe 930, as more closely depicted in FIG. 8, is led into inside of a respective mixing device 805. For example, as depicted in FIG. 8, a pressure medium pipe 930 may be led into inside of device 805 at an end of a suction pipe 920 of the device so that pressurized air is discharged into inside of the suction pipe 920 in a discharge direction of the device 805. The discharged pressurized air sucks salt lake water into a suction opening of the device 805. The mixture of salt lake water and air exits at an opposite end of the suction pipe 920, the outlet opening. The directions of propagation of water and air are illustrated by arrows. Alternatively, one or more propellers or other suitable mixing device(s) is/are used instead or in addition of the ejector(s).

Figure 5:
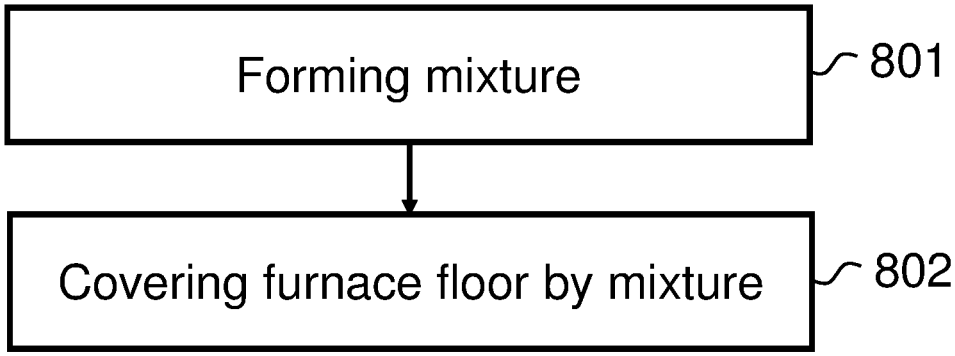
FIG. 5 shows a flow chart of a method in accordance with an embodiment.

FIG. 5 shows a flow chart of a method in accordance with an embodiment. In the first step 801, material is mixed with a fluid to form a mixture (the material not yet being on the furnace floor). And, in the second step 802, the furnace floor is covered by the mixture. In certain embodiments, both steps 801 and 802 occur on the furnace floor, and the steps may be overlapping in the sense that the furnace floor becomes covered by the mixture during the mixing step.

In certain embodiments, the material that is mixed with fluid comprises at least two different salts.

In certain embodiments, the material comprises at least two different salts selected from a group consisting of: sodium carbonate, sodium sulfate, sodium sulfide, sodium chloride, potassium carbonate, and potassium sulfate.

In certain embodiments, the method comprises using a mixture whose melting point, after solidification, is lower than 850° C. Examples of such mixtures are the mixture of sodium sulfate and sodium carbonate, the mixture of sodium sulfate, sodium carbonate and sodium sulfide, the mixture of sodium sulfate, sodium carbonate, potassium sulfate and potassium carbonate.

In certain other embodiments, conventional protective materials, such as mere sodium sulfate or mere sodium carbonate is used.

Without limiting the scope and interpretation of the patent claims, certain technical effects of one or more of the example embodiments of this disclosure are listed in the following. A technical effect is that the protective material can be transferred onto the furnace floor and it spreads evenly without the need of any worker being inside of the furnace during the transfer and spreading. Another technical effect is faster transfer and spreading of the protective material. Another technical effect is a shortened recovery boiler outage time due to the fact that the transfer and spreading of the protective material can be performed simultaneously with the removal of the safety roof in an upper portion of the furnace. Another technical effect is easier removal of the protective layer when needed due to using material mixtures having lower melting temperature.

Various embodiments have been presented. It should be appreciated that in this document, words comprise, include and contain are each used as open-ended expressions with no intended exclusivity.

The foregoing description has provided by way of non-limiting examples of particular implementations and embodiments of the present disclosure a full and informative description of the best mode presently contemplated by the inventors for carrying out the present disclosure. It is however clear to a person skilled in the art that the present disclosure is not restricted to details of the embodiments presented in the foregoing, but that it can be implemented in other embodiments using equivalent means or in different combinations of embodiments without deviating from the characteristics of the present disclosure.

Furthermore, some of the features of the afore-disclosed embodiments of this present disclosure may be used to advantage without the corresponding use of other features. As such, the foregoing description shall be considered as merely illustrative of the principles of the present disclosure, and not in limitation thereof. Hence, the scope of the present disclosure is only restricted by the appended patent claims.

The invention claimed is:

1. A method for protecting a furnace floor of a furnace of a black liquor recovery boiler, comprising:

mixing protective material with a fluid to form a mixture comprising said protective material;

covering the furnace floor by said mixture by allowing the mixture to stay on the furnace floor or by flowing the mixture onto the furnace floor; and forming a salt lake onto the furnace floor extending over the furnace floor from side to side during an outage of the black liquor recovery boiler.

2. The method of claim 1, comprising:

causing the mixture to flow onto the furnace floor from the outside of the furnace via an opening in a wall of the black liquor recovery boiler.

3. The method of claim 1, comprising pumping the mixture onto the furnace floor from the outside of the furnace.

4. The method of claim 3, wherein said mixing is performed during said pumping or prior to said pumping.

5. The method of claim 1, comprising performing the act of covering the furnace floor with said mixture simultaneously with a removal of a furnace safety roof during the outage of the black liquor recovery boiler.

6. The method of claim 1, comprising settling the flown mixture on the furnace floor by gravity alone.

7. The method of claim 1, comprising allowing the salt lake to solidify forming a protective layer to protect floor tubes of the furnace from direct exposure of black liquor and flame impingement.

8. The method of claim 1, wherein the protective material comprises at least two different salts.

9. The method of claim 1, wherein the protective material comprises at least two different salts selected from a group consisting of: sodium carbonate, sodium sulfate, sodium sulfide, sodium chloride, potassium carbonate, and potassium sulfate.

10. The method of claim 1, comprising using a mixture whose melting point, after solidification, is lower than 850° C.

11. The method of claim 1, comprising mixing the protective material on the furnace floor with a fluid or water by a mixing device or by a plurality of mixing devices.

12. A method for protecting a furnace floor of a black liquor recovery boiler, comprising:

mixing protective material with a fluid to form a mixture comprising said protective material;

covering the furnace floor by said mixture by allowing the mixture to stay on the furnace floor or by flowing the mixture onto the furnace floor; and performing the act of covering the furnace floor with said mixture simultaneously with a removal of a furnace safety roof during an outage of the black liquor recovery boiler.

13. A method for protecting a furnace floor of a black liquor recovery boiler, comprising:

mixing protective material with a fluid to form a mixture comprising said protective material;

covering the furnace floor by said mixture by allowing the mixture to stay on the furnace floor or by flowing the mixture onto the furnace floor; and mixing the protective material on the furnace floor with a fluid or water by a mixing device or by a plurality of mixing devices.

* * * * *